US005402546A

United States Patent [19]

Baranowski

[11] Patent Number: 5,402,546

[45] Date of Patent: Apr. 4, 1995

[54] ACCESS FACILITATING SYSTEM FOR CHAIR ASSISTED PASSENGERS EMBARKING OR DISEMBARKING A SMALL AIRCRAFT

[76] Inventor: Edwin M. Baranowski, 75 Marrus Dr., Gahanna, Ohio 43230-2154

[21] Appl. No.: 86,252

[22] Filed: Jul. 1, 1993

Related U.S. Application Data

[63] Continuation-in-part of Ser. No. 826,838, Jan. 27, 1992, Pat. No. 5,319,818.

[51] Int. Cl.[6] ..... E01D 15/00

[52] U.S. Cl. ..... 14/69.5; 14/71.1

[58] Field of Search ..... 14/69.5, 71.1, 71.3, 14/72.5, 71.5; 280/5.2, 5.24, 250.1; 180/8.2; D12/345; D34/32; 52/179, 180, 181, 182

[56] References Cited

U.S. PATENT DOCUMENTS

| | | | |
|---|---|---|---|
| 3,910,264 | 10/1975 | Mahieu | 182/63 |
| 4,127,201 | 11/1978 | Baumann | 14/69.5 |
| 4,528,711 | 7/1985 | Packer | 14/69.5 |
| 4,712,264 | 12/1987 | Voith | 14/69.5 |
| 5,143,324 | 9/1992 | Cornelius et al. | 244/129.6 |
| 5,197,750 | 3/1993 | Digeorge | 280/250.1 |
| 5,269,036 | 12/1993 | Yan et al. | 14/69.5 |
| 5,277,436 | 1/1994 | Frank et al. | 280/5.2 |
| 5,301,971 | 4/1994 | Brereton et al. | 280/250.1 |

*Primary Examiner*—Ramon S. Britts
*Assistant Examiner*—Pamela A. O'Connor

[57] ABSTRACT

Access means for chair carried passengers embarking or disembarking an aircraft in which a pair of separate spaced-apart longitudinally extended pathways are disposed to traverse a stairway leading to the aircraft cabin, and the pathways each receive one side of the chair in the course of transport of the chair over the stairway, and the space between the spaced apart pathways is an opening which does not obstruct the footing surface of the stairway for the chair carrying personnel.

15 Claims, 2 Drawing Sheets

ACCESS FACILITATING SYSTEM FOR CHAIR ASSISTED PASSENGERS EMBARKING OR DISEMBARKING A SMALL AIRCRAFT

This is a continuation-in-part of my application Ser. No. 07/826,838, filed on Jan. 27, 1992, now U.S. Pat. No. 5,319,818, the content of which is incorporated herein by reference.

This invention relates to chair access means for small aircraft, such as aircraft used for commercial commuter and/or hub feeder routes. Representative of such aircraft are Beechcraft 1900, Embrarer EMB-110 and 120, Boeing Canada DHC-2, Saab SF340 and the like. The invention facilitates the access of chair carried passengers to the cabin of a small aircraft as the passenger embarks or disembarks. The invention is a useful access means for wheelchair or carried passengers, for example, where jetways are not available, and passengers embark and disembark on the airplane directly through the gangway door to the runway, or where a portable set of stairs, usually wheeled to the aircraft connects to the aircraft doorway. Most generally, the invention is an access means for chair carried passengers embarking or disembarking an aircraft in which a pair of separate spaced-apart longitudinally extended pathways are disposed to traverse a stairway leading to the aircraft cabin, and the pathways each receive one side of a chair in the course of transport of the chair, and the passenger in the chair, over the stairway, and the space between the spaced apart pathways is an opening which does not obstruct the footing surface of the stairway for the airline personnel carrying the chair.

In the prior art, a person requiring wheelchair assistance for airplane travel is, most of the time, first seated in a device known as a "straightback," an "aisle chair," a "gurney" or other moniker, and, while in the chair, is carried to an assigned seat in the aircraft cabin. A chair of such a type is shown in FIG. 1 at reference numeral 20. The chair is a narrow device having a seat protruding from a straight back, and a foot prop at the bottom. Typically two small wheels are at the back of the chair. The wheels may be inside, outside, or aligned flush with the chair side frame. For access to the cabin area of a small aircraft, the passenger is strapped in the chair, and physically carried up the gangway stairs and seated in the aircraft. Two personnel, usually strangers to the passenger, and of unknown experience and strength, are required to do the lifting. The experience may be unnerving, if not terrifying, to the carried passenger, and the airline staff. (The gangway stairs are usually very steep and require substantial lifting effort.)

An object of the invention is to facilitate access to small aircraft by persons who require chair carried assistance. In so achieving its object, the means of the invention will also reduce stress and effort on the part of airline personnel assisting such persons, and should provide an enhanced degree of comfort and safety to all concerned.

The invention is understood more readily by reference to the following description of the preferred embodiment, taken in conjunction with the drawings in which.

(For clarity in the figures, the passenger is not shown, but is, however, for purposes of this application, assumed to be in the chair.)

Figure 1:
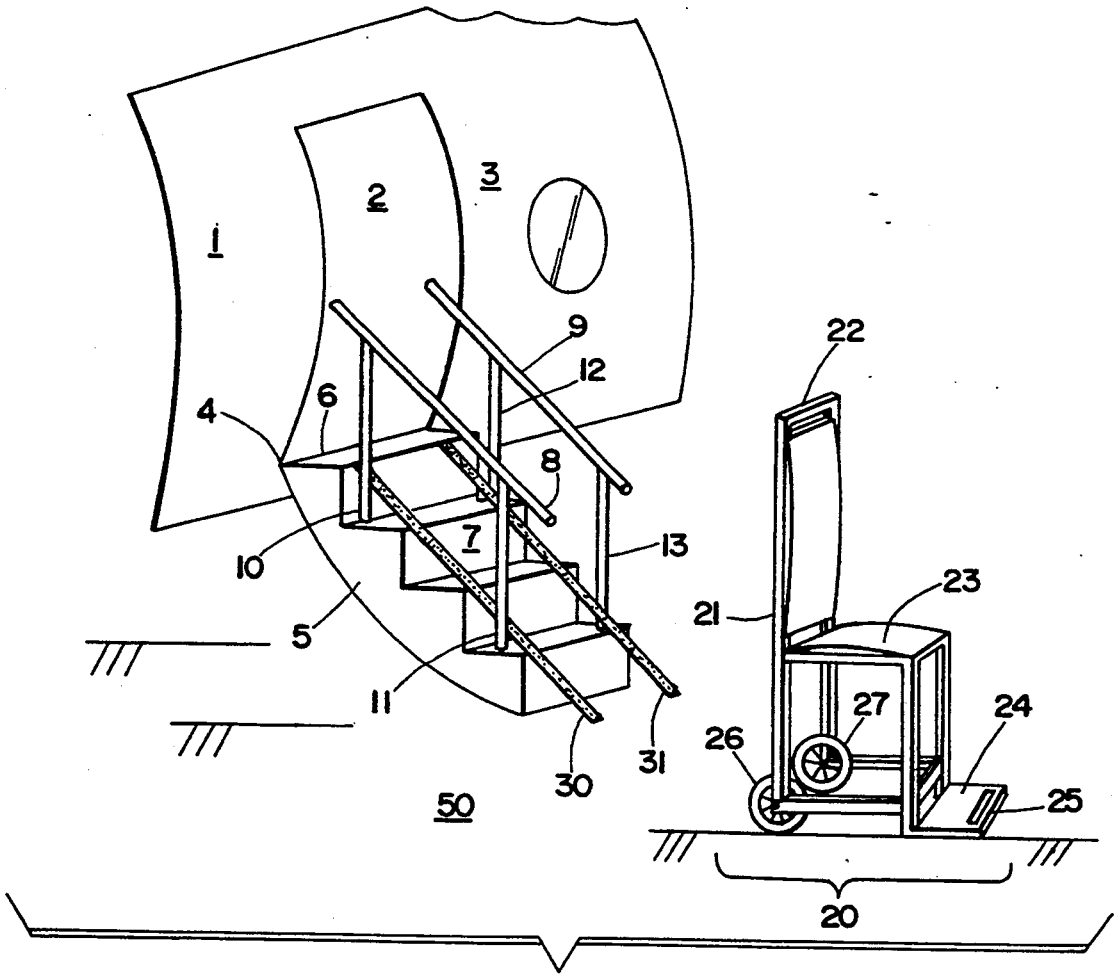
FIG. 1 shows a typical deployment of a straightback chair and a small commercial aircraft on a runway.

With reference to FIG. 1, there is shown a side portion of a small commuter, or passenger aircraft 1, having a hatch or doorway 2 in the fuselage 3 thereof. The bottom edge 4 of the door 5 is hinged to a support 6 at the side of the aircraft. When in the open position as shown in FIG. 1, the door hangs downwardly from the aircraft body, and in this position, forms a stairway 7 leading from the ground 50 into the aircraft. The distance from the bottom stair to the ground is about a foot. Typically, rails, a cable, or other support, 8 and 9, and vertical supports 10 and 11, and 12 and 13, are included at sides of the stairs. The stairway is usually narrow (approximately less than about 24 inches) and retracts into the interior of the aircraft when the door is closed.

The straightback chair is illustrated at 20, having a frame with a straight back 21, with upper handle 22, seat 23, foot support 24, with lower handle 25 and two small side wheels 26 and 27. Chairs in use are about approximately 50 to 60 inches high and about 12 inches wide. In the normal course, the passenger is seated in the chair, two safety straps secure the passenger on the chair, and two airline personnel, one at the upper handle 22, and the other at the lower handle 25 lift the passenger and chair up the stairway, stair by stair, into the aircraft. It is evident that it may be necessary for the assistant at the upper handle to do considerable downward bending as the assistant backs up the stairs. Likewise the front assistant may assume some physiologically uncomfortable position. The overall weight distribution between front and back, affecting strength and effort needed, may also be indeterminate between the two assistants at the upper and lower handles.

Figure 2:
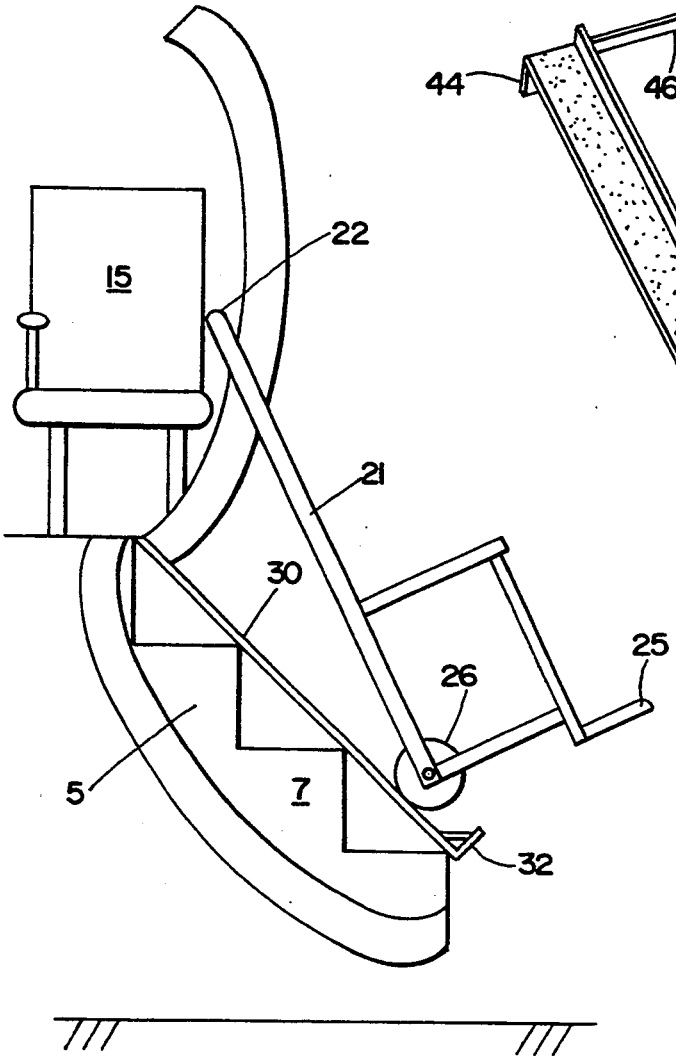
FIG. 2 is a side view of a cross-section of an aircraft cabin and open hatchway door showing, the use of the invention up or down a gangway.

An aspect of this environment affected by the invention is the provision of two narrow pathways, 30 and 31, as shown in FIG. 1, for the side wheels 26 and 27 at each side of the straightback chair, at each side of the stairway 7. With reference to FIG. 2, it can be seen that the person and chair can be pulled at handle 22 and/or pushed at handle 25 and rolled up the inclined plane provided by the pathway 30 in a relatively smooth and certain operation, as opposed to the uncertainty of the conventional stair by stair lifting process. In the pathway shown in FIG. 2, the ends of each pathway include a "stop" 32, such that once the chair is lifted up, and disposed on the pathways, the assistants, after this initial exertion of effort, can regroup, or reorient themselves for the second step of the push, pull and roll upward conveyance of the passenger to the aircraft seat 15. As a result of the deployment of the invention, the mechanical advantage of an inclined plane is achieved for the chair, while the stable and familiar footing of an intact stairway is preserved for the assistants. The pathways do not obstruct the stairway, and access to the stairway is maintained despite the presence of the pathways. While the foregoing description relates to embarking on an aircraft, and carrying the passenger up, disembarking is the reverse process, the carried passenger is taken down the stairway, subject to comparable considerations.

Figure 3:
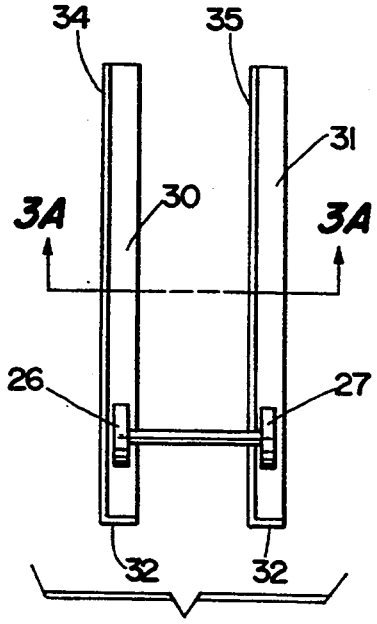
FIG. 3 is a top view which shows the relationship of straightback chair wheels to the pathway means of the invention.
Figure 3A:
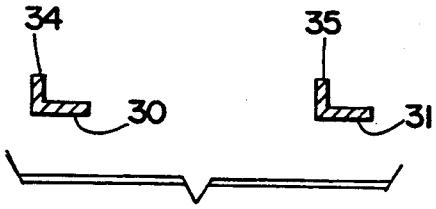
FIG. 3A is a cross-section of the device shown in FIG. 3 at section 3A—3A.

FIG. 3 shows, in a top view, side rails or a lipped edge 34 and 35 on the edge of each pathway, which are useful with the pathways to prevent the side wheels of the chair from deviating therefrom. Because the stairway 7 is usually narrow and includes rails 8 and 9 which define the upper width of the overall passageway, the potential sideways movement of the chair is self-limited in the boundaries defined by the elements 8 and 9 and 30 and 31. To accommodate different chair widths, or different pathway spacings, the respective separation distances between the pathways, or the wheels may be variably adjustable. A cross-section through the pathways is shown in FIG. 3A. In FIG. 3, the side wheels of a chair, about 2.0 inches wide each, are shown in relationship to the pathways. An enhancement of the straightback chair for use with the system of the invention would be to provide the wheels 26 and 27 with a ratchet or other mechanical brake mechanism, allowing movement in one direction only, to reduce necessary effort and to prevent slipping or loss of control if the assistants otherwise encounter a carriage failure. Preferably, the passageway members include a slip-resistant surface which securely engages with the rubber or composition wheels of the straightback chair.

Figure 4:
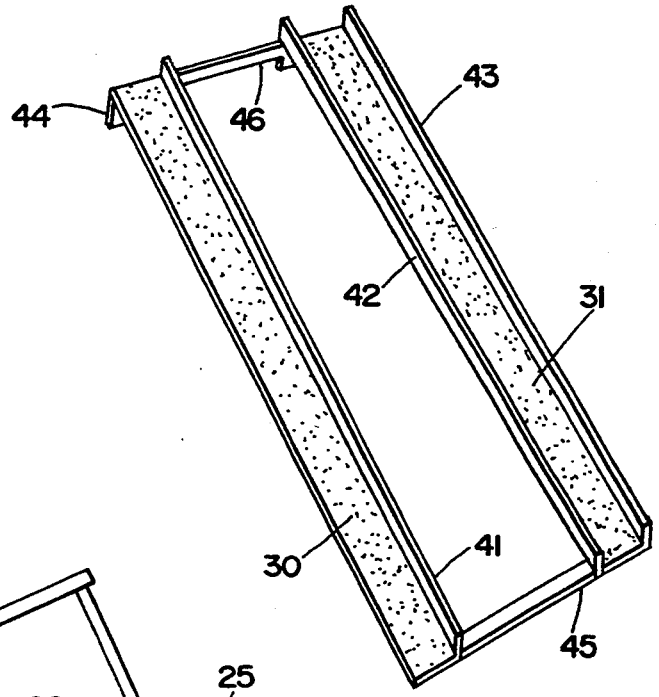
FIG. 4 shows a variation of the invention.
Figure 5:
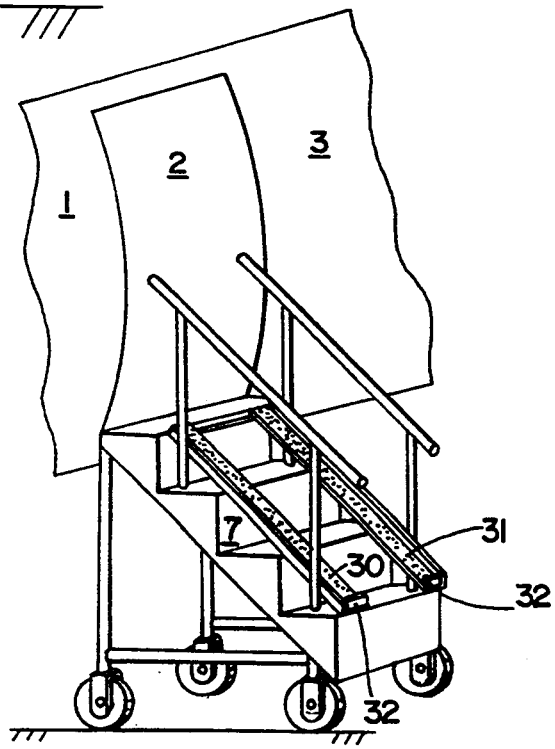
FIG. 5 shows the invention utilized on a wheeled set of portable cabin stairs.

My prior referenced application describes installation variations for a pathway type device which preserves stair access for an able bodied assistant and simultaneously provides an inclined plane advantage for the chair in an assisted passage over a barrier. Also described are means to maintain the device "transparent" to its installation, such that it does not hinder normal stairway access, despite its presence for potential use when needed. For example, narrow pathways may be permanently and intrinsically installed for deployment at each side of the doorway stairs; pathways may be hinged perpendicularly to supports 10 and 11 and 12 and 13 for deployment when needed; a pathway system formed from multiple sections which telescope laterally or longitudinally is an alternative; an assembled pathway system, such as shown in FIG. 4, may be conveniently stored in the closet, or baggage area of the aircraft, or at the departure/arrival gate. Another alternative would be to secure a set of removable companion pathways, such as in the form shown in FIG. 4, to the back 21 of the straightback chair; thus, the chair and its ancillary pathway equipment, would be maintained together as a single unit with a pathway optimally fitted to the width of the chair wheels, as they would be used together when needed. In FIG. 4, the pathways 30 and 31 are shown with a single lip 41 and double lips 42 and 43 as alternatives for the side edges of the pathways. The lips at the side edges are not per se necessary, but may facilitate use of the invention. Also shown in FIG. 4 at 44 is a fitment, such as a folded edge, peg connector or other means which secures the device adjacent the stairway, for example, to support 6 at the hatchway door. The pathways of FIG. 4 are maintained apart from each other the distance required by the chair width as shown in FIG. 3, by braces 45 and 46 which adapt the device to the width of the chair.

What is claimed is:

1. An apparatus for assisting a wheelchair challenged person into an aircraft having a passenger cabin and a hatchway providing an entrance into the cabin, the hatchway being secured by a door that includes, on the aircraft interior side thereof, deployable cabin stairs leading to and from the cabin when the door is opened, in which, the person is seated in an aircraft aisle chair having a seat and a foot support, in which chair the person is seated and assisted by personnel who direct the chair into the passenger cabin, said chair having support structure at each opposite side thereof, comprising a pair of separate spaced-apart longitudinally extended pathways disposed to traverse the cabin stairs, each pathway having a width sufficient to accommodate the support structure on one side of the chair, and a length sufficient to traverse the cabin stairs, the space between the pathways being sufficient in width such that each pathway is disposed to receive a side of the support structure of a corresponding side of the chair;

at least one of said pathways being secured to a support adjacent the cabin stairs such that the pathway may be securely disposed thereto;

the other of said pathways being securely disposed to traverse said cabin stairs, parallel to and spaced apart from the one of said pathways, such that the one and the other pathways each traverse the cabin stairs, and are each capable of receiving one side support of the chair, in the course of transport of the chair with a person seated therein, with respect to the cabin stairs, and the space between the spaced apart pathways is an opening which provides access to the cabin stairs for the personnel who direct the chair.

2. An accessibility means for achieving the assisted embarking and disembarking of a passenger seated in an aircraft aisle chair and the passage of personnel assisting the passenger in the chair, into and from an aircraft cabin having a seat for the passenger, the cabin being elevated with respect to a ground level and having an entrance through a hatchway, including:

cabin stairs comprising a single flight stairway having a width essentially corresponding to the width of the hatchway, said stairs leading to and from the cabin hatchway;

a pair of spaced-apart extended pathways, each pathway being longitudinally disposed to traverse the front edges of the cabin stairs along a length of the stairway and adapted in width to accommodate one side each of each side of the chair, said pathways being parallel to and separated from each other a sufficient lateral distance such that each pathway is capable of separately receiving a side of the aisle chair on each opposite side of the chair, the separation distance between the pathways forming an opening permitting access to a footpath in the cabin stairs for personnel assisting the passenger, said pathways being secured to a support adjacent the cabin stairs.

3. The device of claim 1 or claim 2 in which a lower side of the chair includes a wheel engageable with a respective pathway on a corresponding side of the stairway.

4. The device of claim 3 having a mechanism allowing only unidirectional rotation of the wheel.

5. The device of claim 4 in which the mechanism is a ratchet.

6. The apparatus of claim 2 in which the stairway is a portable stairway brought to an open aircraft cabin hatchway.

7. The apparatus of claim 1 or claim 2 in which a pathway includes a stop mechanism, preventing downward movement of the chair, at the lower section thereof.

8. The apparatus of claim 1 or claim 2 in which at least one of the pathways includes an upwardly extending lip on at least one side edge thereof.

9. The apparatus of claim 7 in which the stop includes an upwardly extending extension of the lower end of the pathway.

10. The apparatus of claim 1 or claim 2 in which at least one of the pathways is hingingly secured to a support on a side edge of the cabin stairs.

11. The apparatus of claim 1 or claim 2 in which the pathways are formed from longitudinally telescoping sections that traverse the front edges of the stairs.

12. The apparatus of claim 1 or claim 2 in which the pathways are provided in a fixed assembly adapted to be stored at one or more of the aircraft and an airport gate.

13. The apparatus of claim 1 or claim 2 in which the aisle chair and the pathways are each adapted to a predetermined size and maintained as a unit.

14. The apparatus of claim 1 or claim 2 in which the aisle chair includes side wheels and the pathways include an upper slip resistant surface for engagement with the wheels of the aisle chair.

15. The apparatus of claim 1 or claim 2 in which the pathways include a fitment for securing the pathways adjacent the cabin stairs.

* * * * *